US006652117B2

(12) United States Patent
Tsai

(10) Patent No.: US 6,652,117 B2
(45) Date of Patent: Nov. 25, 2003

(54) LIGHT CASING

(76) Inventor: Tien-Tzu Tsai, No. 248, Kao Kung Rd., Nan Dist., Taichung City (TW)

( * ) Notice: Subject to any disclaimer, the term of this patent is extended or adjusted under 35 U.S.C. 154(b) by 0 days.

(21) Appl. No.: 10/091,185

(22) Filed: Mar. 6, 2002

(65) Prior Publication Data

US 2002/0163803 A1 Nov. 7, 2002

(30) Foreign Application Priority Data

May 4, 2001 (DE) ..... 201 07 595 U

(51) Int. Cl.[7] ..... F21V 23/02

(52) U.S. Cl. ..... 362/221; 362/217; 362/224; 362/225; 362/371

(58) Field of Search ..... 362/217, 224, 362/225, 239, 241, 249, 250, 252, 362, 367, 368, 370, 371, 396, 432; 248/343, 344; 403/331, 363, 381, 326, 327, 329, 315–317

(56) References Cited

U.S. PATENT DOCUMENTS

| | | | | | |
|---|---|---|---|---|---|
| 4,933,820 | A | * | 6/1990 | Engel | 362/217 |
| 5,658,067 | A | * | 8/1997 | Engle et al. | 362/222 |
| 6,174,069 | B1 | * | 1/2001 | Plunk et al. | 362/147 |
| 6,179,511 | B1 | * | 1/2001 | Gassler | 403/322.1 |
| 6,247,828 | B1 | * | 6/2001 | Herst | 362/217 |
| 6,428,183 | B1 | * | 8/2002 | McAlpin | 362/225 |

* cited by examiner

*Primary Examiner*—Sandra O'Shea
*Assistant Examiner*—Guiyoung Lee
(74) *Attorney, Agent, or Firm*—Charles E. Baxley

(57) ABSTRACT

A light casing includes a top part and two side parts which are snapped to two ends of the top part. Each of the two side parts has a groove defined in an outer periphery thereof so that two rails are engaged with the two grooves. A mediate member is connected between the two side parts and two end plates are respectively connected to the two ends of the top part and the two side parts. Lamps are connected between the two end plates and located in the mediate member. Two light casings are able to be connected with each other by using a connection block engaged with two respective grooves of the two light casing.

9 Claims, 7 Drawing Sheets

LIGHT CASING

FIELD OF THE INVENTION

The present invention relates to a light casing which has two grooves on two sides thereof so as to be connected with another light casing.

BACKGROUND OF THE INVENTION

A conventional light casing is an elongated casing and includes a top and two sidewalls which are connected to two sides of the top and an opening is defined between the two sidewalls. Lamps are connected to support frames extending from an inside of the top and a transparent plate is engaged with the opening. The conventional light casing has a fixed shape and cannot be expanded to increase the light area so that if the users want to have more light, several individual light assemblies are to be installed on the ceiling. Another type of track light assembly includes a track which is fixed to the ceiling and multiple of lights are slidably connected to the track. However, the track light assembly has its own specification and parts which are not cooperated with ordinary light casings.

The present invention intends to provide a light casing that can be connected with each other and two rails may be connected to the casing to allow the light casing to be slidable.

SUMMARY OF THE INVENTION

The present invention relates to a light casing and comprises a top part with two side parts respectively connected to two ends of the top part. Each of the side parts has a top member and a bottom member, and a connection section is connected between the top member and the bottom member. A groove is defined between the top member and the bottom member. A mediate member is connected between two respective bottom members of the two side parts. Two end plates are respectively connected to the two ends of the top part and the two side parts.

The primary object of the present invention is to provide a light casing that can be cooperated with rails or connected with another light casing.

The present invention will become more obvious from the following description when taken in connection with the accompanying drawings which show, for purposes of illustration only, some preferred embodiments in accordance with the present invention.

DETAILED DESCRIPTION OF THE PREFERRED EMBODIMENT

Figure 1:
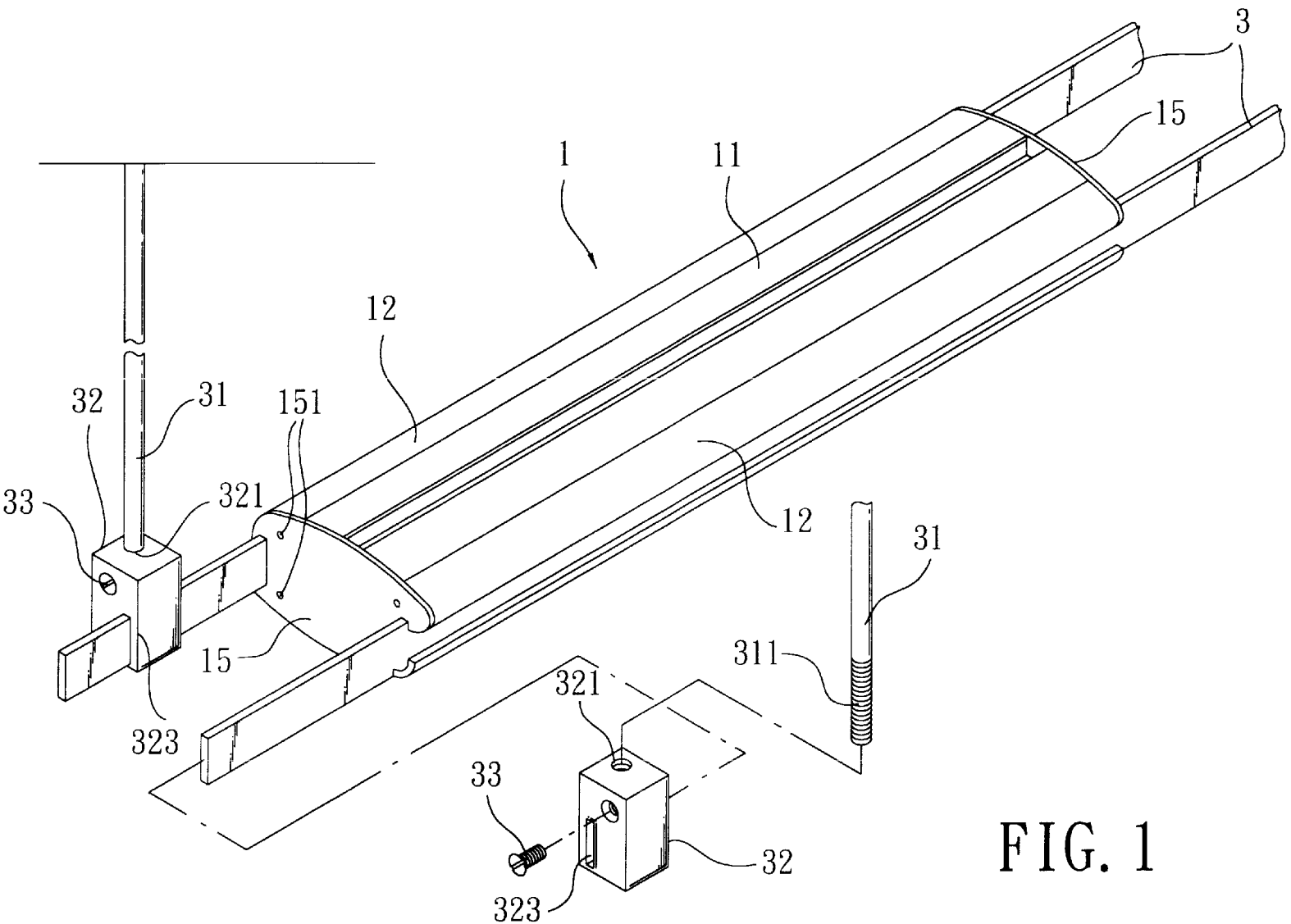
FIG. 1 is an exploded view to show a light casing of the present invention and two rails held by two rods.
Figure 2:
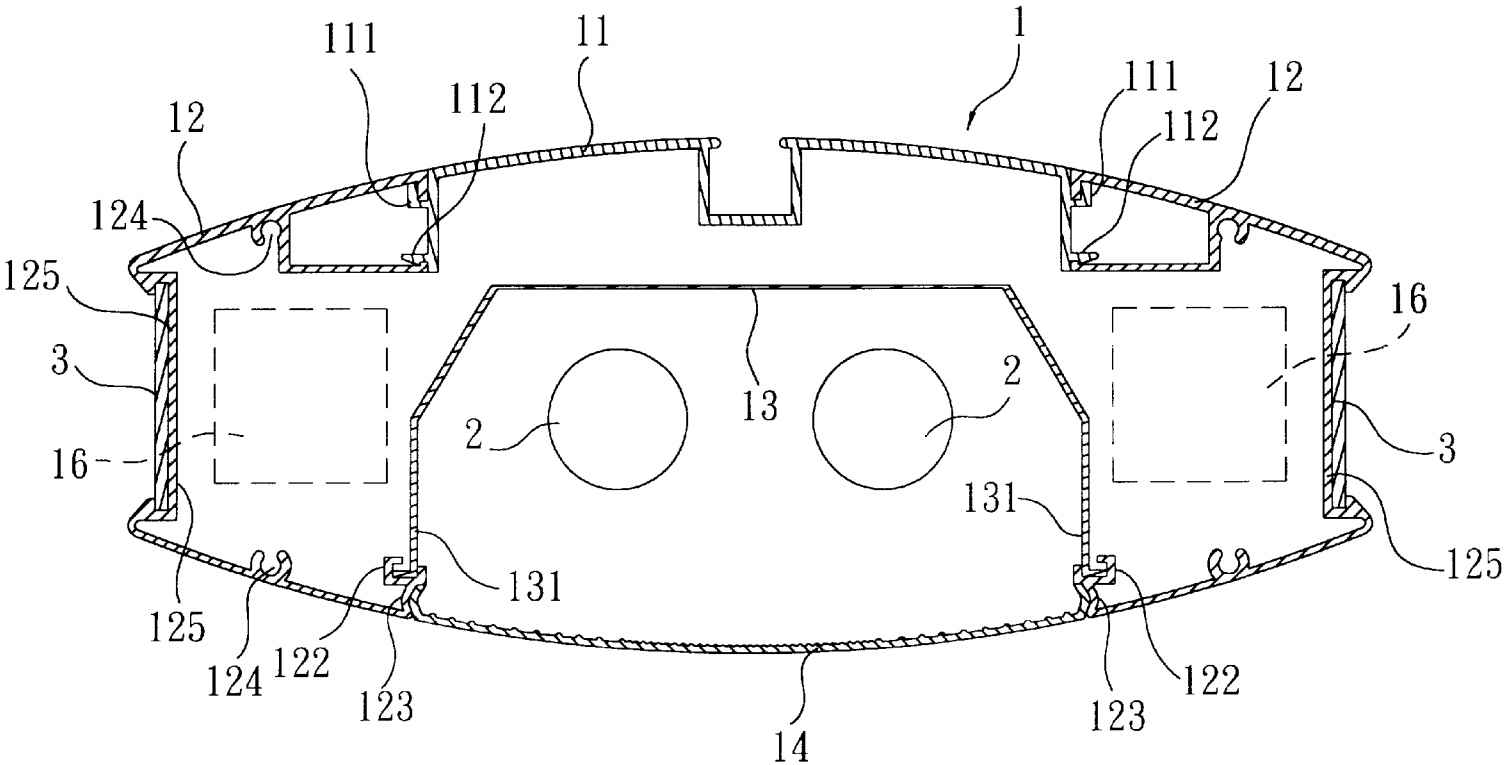
FIG. 2 is a cross sectional view to show the light casing of the present invention.
Figure 3:
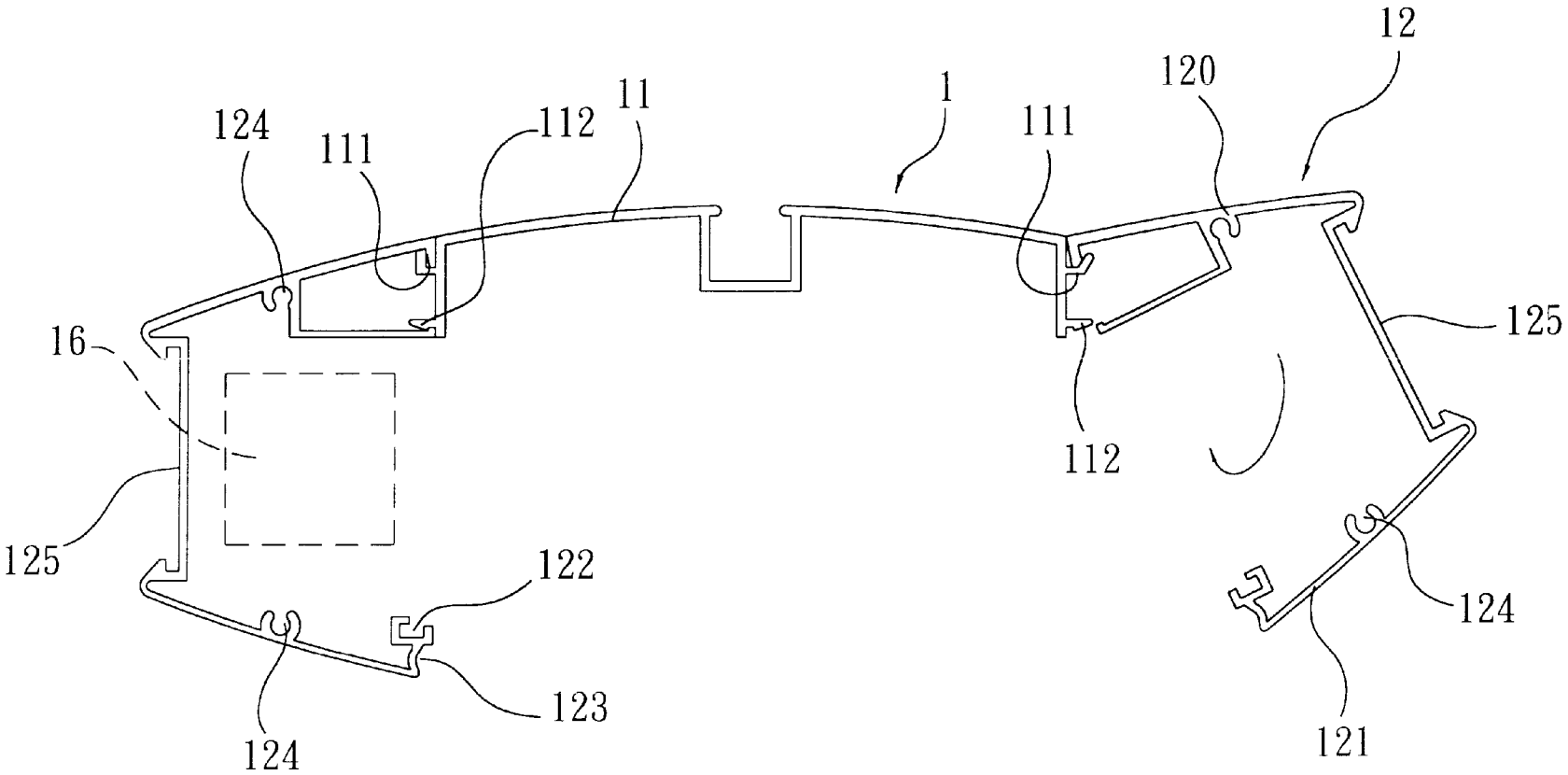
FIG. 3 is an end view to show the two side parts are snapped to the top part of the light casing.

Referring to FIGS. 1 to 4, the light casing of the present invention comprises a top part 11 which has two sidewalls and each of the sidewalls has a first connection port 111 and a second connection port 112. Two side parts 12 are respectively connected to two sidewalls of the top part 11 and each of the side parts 12 has a top member 120 and a bottom member 121. A connection section is connected between the top member 120 and the bottom member 121. A groove 125 is defined between the top member 120 and the bottom member 121. Each of the two side parts 12 has a first engaging port for connecting with the first connection port 111 and a second engaging port for connecting with the second connection port 112. Each of the bottom members 121 has a flange 123 extending from an edge thereof and a connection port 122 is connected to the flange 123. A U-shaped mediate member 13 has two sides 131 thereof connected to the two connection ports 122. A transparent face plate 14 is engaged between the two flanges 123 of the two bottom members 121 of the two side parts 12. Tow end plates 15 are respectively connected to the two ends of the top part 11 and the two side parts 12. Each of the top members 120 and each of the bottom members 121 have a screw receptacle 124 so that screws 151 extend through the end plates 15 and connected to the two screw receptacles 124. Two lamps 2 are connected between the two end plates 15 and located between the two sides 131 of the mediate member 13. The necessary electric parts 16 are received in the two side parts 12.

Two rails 3 are respectively engaged with the two grooves 125 of the two side parts 12 and each of the rails 3 is held by a rod 31 which is connected to a ceiling. Each of the rods 31 is connected to a member 32 through which a passage 323 is defined so as to allow the rail 3 to pass. Each of the members 32 has a threaded hole 321 for connecting to a threaded section 311 of the rod 31. In order to secure the connection between the rod 31 and the member 32, a bolt 33 extends through the member 32 and contacts against the rod 31.

Figure 4:
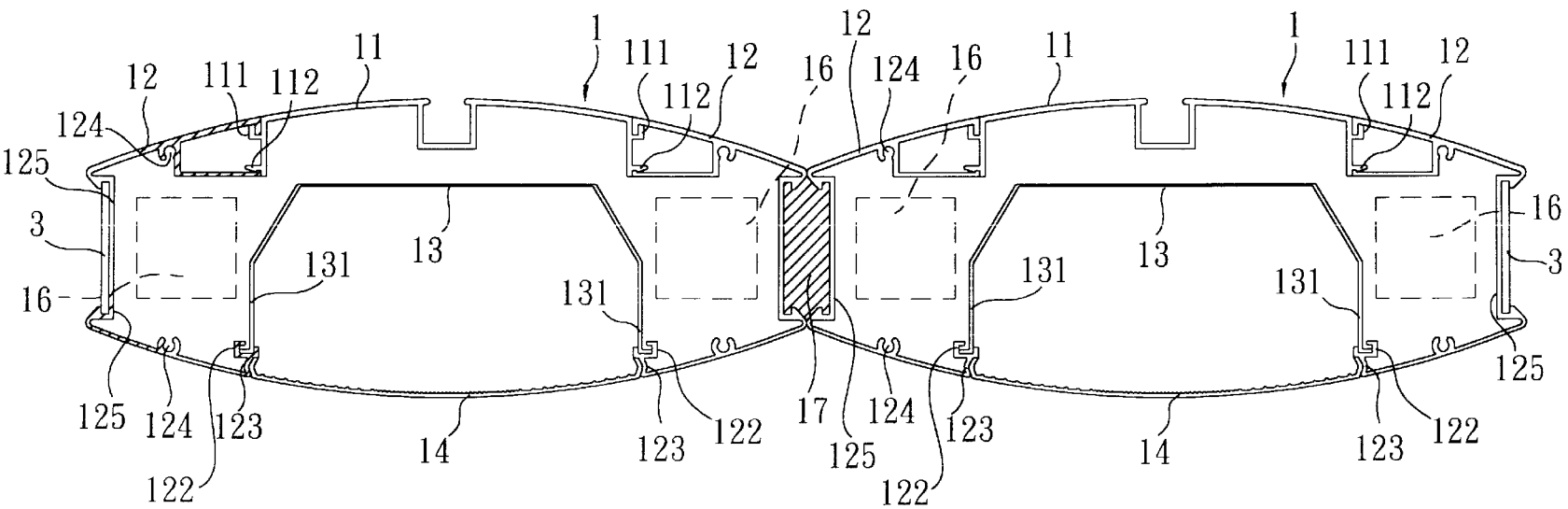
FIG. 4 is a cross sectional view to show that two light casings of the present invention are connected by a connection block.

As shown in FIG. 4, a connection block 17 is engaged with two respective grooves 125 of two light casings 1 so that the number of the light casing 1 can be added as desired.

Figure 5:
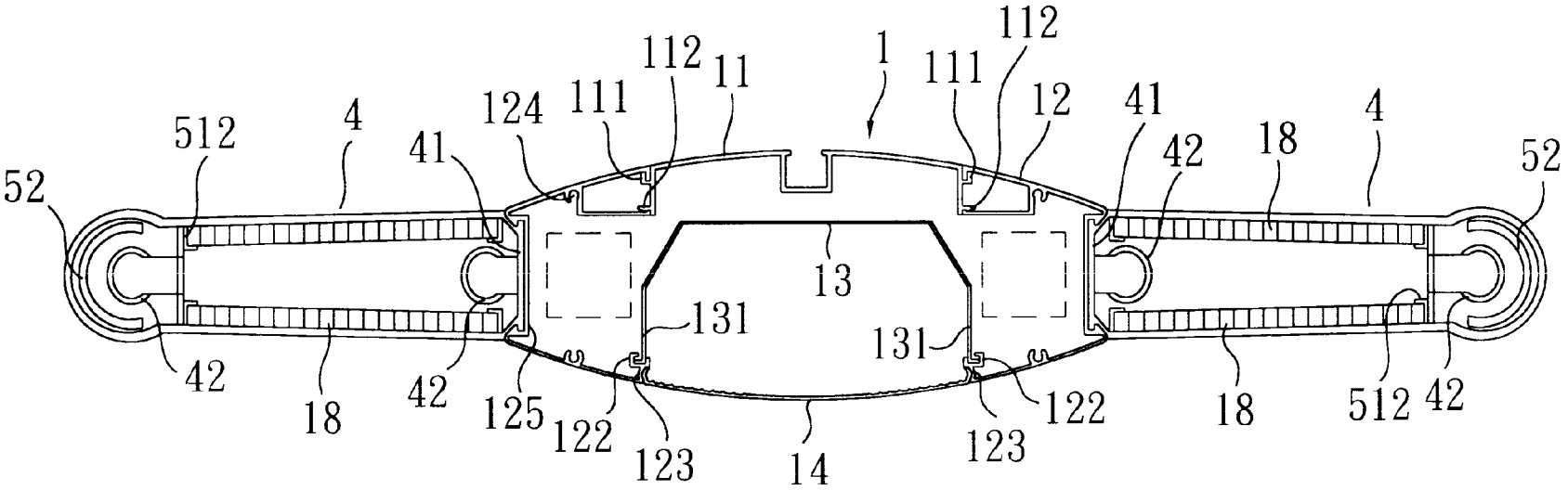
FIG. 5 is a cross sectional view to show that two extending light casings are connected to the light casing of the present invention.
Figure 6:
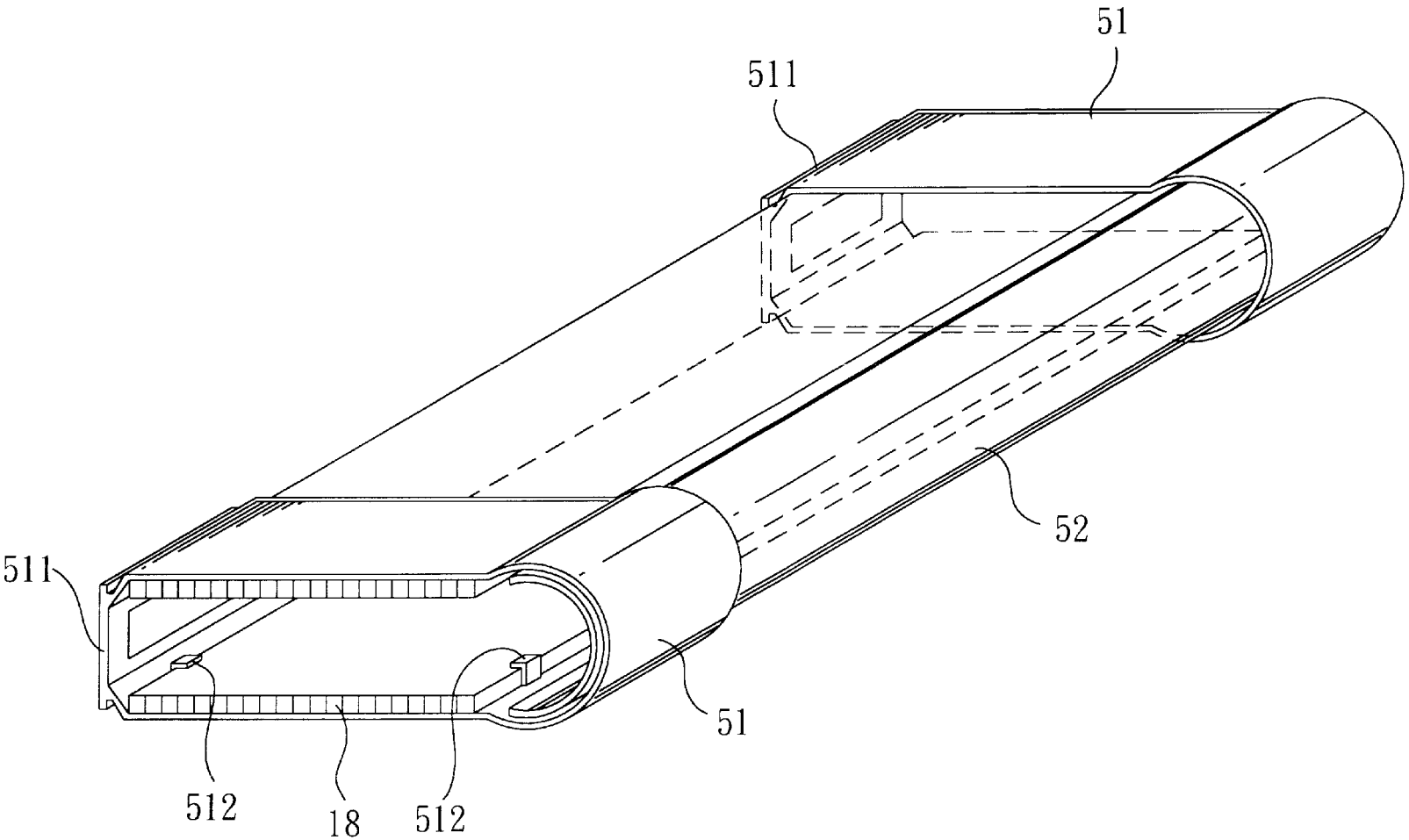
FIG. 6 is a perspective view to show the extending light casing of the present invention.
Figure 7:
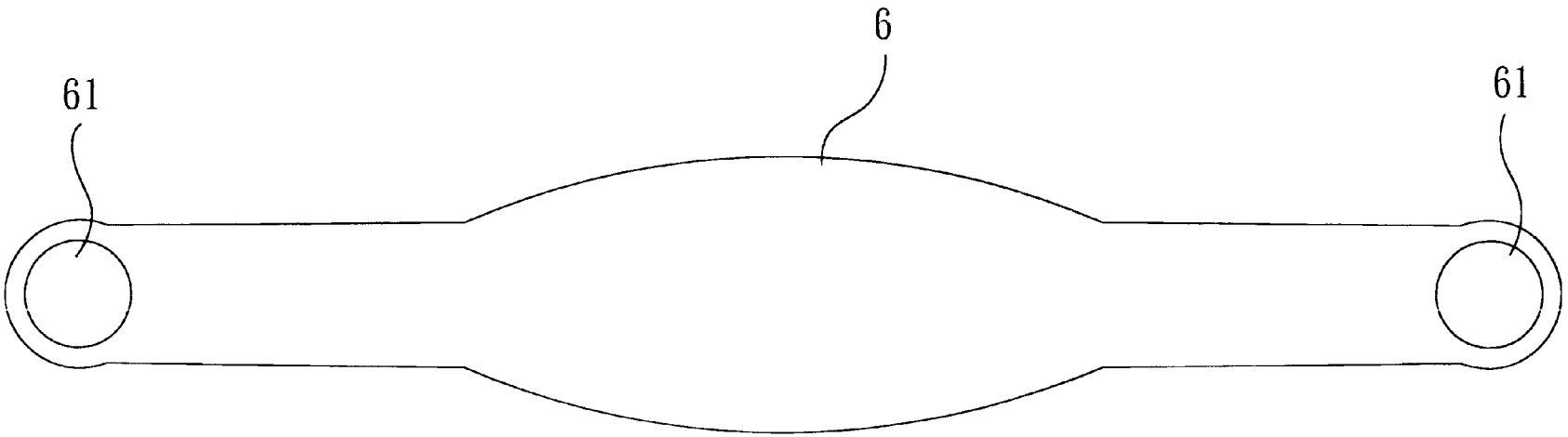
FIG. 7 is an end plate cooperated with the light casing and the two extending light casings.

FIG. 5 shows that two extending light casings 4 are respectively engaged with the two grooves 125 of the light casing 1. Each of the extending light casings 4 has an engaging end 41 which is slidably engaged with the grooves 125 and two lamps 42 are received in each of the extending light casings 4. Reflection layers 18 are connected to an inside of the extending light casing 4 by clamps 512 so as to reflect the light from the lamps 42. Each of the extending light casings 4 has a C-shaped side plate 52 which is located beside the outermost lamp 42 in a longitudinal direction. FIG. 6 shows that the extending light casing 1 can be composed of two loop-shaped retainers 51 and two ends of the side plate 52 are retained in the two retainers 51. The reflection layers 18 are located on a top and a bottom of the extending light casing 4 and are positioned to the retainers 51 by the clamps 512. Each of the retainers 51 has an engaging end 511 which is slidably engaged with the groove 125 of the side part 12. FIG. 7 shows the end plate 6 for connection with the extending light casings 4, wherein two holes 61 are defined through the end plate 6 so that rails 3 may go through the holes 61.

The light casing 1 of the present invention can be expanded or movable along two rails 3 so that the light casing 1 is convenient for the users to provide better light feature in different rooms. The light casing 1 may be connected with four legs (not shown) which are connected to the two side parts 12 or connected with the rails 3. The legs can stand on the floor or can be mounted on an object.

While we have shown and described the embodiments in accordance with the present invention, it should be clear to those skilled in the art that further embodiments may be made without departing from the scope of the present invention.

What is claimed is:

1. A light casing comprising:

a top part;

two side parts each having a top member and a bottom member, a connection section connected between said top member and said bottom member, a groove defined between said top member and said bottom member, said two top members respectively engaged with two ends of said top part, each of said bottom members having a flange extending from an edge thereof and a connection port connected to said flange;

a U-shaped mediate member having two sides which are respectively connected to said two connection ports of said two respective bottom members of said two side parts, and two end plates respectively connected to said two ends of said top part and said two side parts.

2. The light casing as claimed in claim 1, wherein said top part has two sidewalls and each of said sidewalls has a first connection port and a second connection port, each of said two side parts having a first engaging port for connecting with said first connection port and a second engaging port for connecting with said second connection port.

3. The light casing as claimed in claim 2 further comprising a face plate engaged between said two flanges of said two bottom members of said two side parts.

4. The light casing as claimed in claim 1 further comprising two rails engaged with said two grooves and each of said rails is held by a rod which is adapted to be connected to a ceiling.

5. The light casing as claimed in claim 1 wherein each of said top member and said bottom member has a screw receptacle for connecting said end plates.

6. The light casing as claimed in claim 1 further comprising a connection block which is engaged with two respective grooves of two light casings.

7. The light casing as claimed in claim 1 further comprising an extending light casing which has one end engaged with said groove.

8. The light casing as claimed in claim 7 wherein said extending light casing includes two loop-shaped retainers and two ends of a side plate are retained in said two retainers.

9. The light casing as claimed in claim 8 wherein each of said retainers has an engaging end which is slidably engaged with said groove of said side part.

* * * * *